US005158509A

United States Patent [19]

Ebaugh et al.

[11] Patent Number: 5,158,509

[45] Date of Patent: Oct. 27, 1992

[54] COMPOSITE STABILIZER UNIT

[75] Inventors: Larry R. Ebaugh; Collin P. Sadler, both of Los Alamos; Gary D. Carter, Espanola, all of N. Mex.

[73] Assignee: The United States of America as represented by the United States Department of Energy, Washington, D.C.

[21] Appl. No.: 627,461

[22] Filed: Dec. 14, 1990

[51] Int. Cl.[5] ..... F42B 10/04

[52] U.S. Cl. ..... 244/3.24; 29/123; 264/274; 264/273; 102/517

[58] Field of Search ..... 244/3.24, 3.23; 29/1.22, 1.23; 102/703, 501, 517; 264/163, 273, 274

[56] References Cited

U.S. PATENT DOCUMENTS

| | | | |
|---|---|---|---|
| 3,238,875 | 3/1966 | Stadler et al. | 244/3.24 |
| 3,756,539 | 9/1973 | Donner et al. | 244/3.24 |
| 3,765,620 | 10/1973 | Donner et al. | 244/3.23 |
| 4,719,860 | 1/1988 | Ruffle et al. | 102/521 |
| 4,732,086 | 3/1988 | Schiestl et al. | 102/513 |
| 4,757,766 | 7/1988 | Ruffle et al. | 102/521 |
| 4,825,518 | 5/1989 | Schiestl et al. | 29/1.2 |

FOREIGN PATENT DOCUMENTS

| | | | |
|---|---|---|---|
| 249525 | 12/1987 | European Pat. Off. | 102/501 |
| 1061958 | 4/1954 | France | 244/3.24 |
| 1077083 | 11/1954 | France | 244/3.24 |
| 1307270 | 9/1962 | France | 244/3.24 |
| 2071825 | 9/1981 | United Kingdom | 244/3.24 |
| 88/7169 | 9/1988 | World Int. Prop. O. | 102/501 |

*Primary Examiner*—Michael J. Carone

*Attorney, Agent, or Firm*—Bruce H. Cottrell; Paul D. Gaetjens; William R. Moser

[57] ABSTRACT

An improved fin stabilized projectile including multiple stabilizer fins upon a stabilizer unit situated at the aft end of the projectile is provided, the improvement wherein the stabilizer fins are joined into the stabillizer unit by an injection molded engineering grade polymer.

18 Claims, 2 Drawing Sheets

COMPOSITE STABILIZER UNIT

FIELD OF THE INVENTION

The present n relates to the field of fin stabilized projectiles. This invention is the result of a contract with the Department of Energy (Contract No. W-7405-ENG-36).

BACKGROUND OF THE INVENTION

Current designs for long rod penetrator military rounds such as the Armor Piercing Fin Stabilized Discarding Sabot (APFSDS) use aluminum and steel stabilizer fins located upon an aft stabilizer unit to maintain flight stability. Such stabilizer fins are designed to meet requirements such as low mass, sleek profile, shell-firing survivability, in-flight ablative resistance, and high partibility. Present stabilizer units including the stabilizer fins are machined as single, integral metal pieces from aluminum or steel. Generally, the stabilizer unit is then joined by threads, by welding or by a crimping process to the penetrator rod of the round or projectile. Such machined one-piece metal stabilizer units suffer several limitations including: in-flight ablation related to the selection of the particular metal; difficulty in achieving any significant weight reduction of the stabilizer unit; and, difficulty in meeting selected producibility criteria such as the speed of production and cost.

U.S. Patents Nos. 4,732,086 and 4,825,518 address one effort at improving the stabilizer fin unit and describe a stabilizer unit wherein metal fin segments are joined to a sleeve of the stabilizer unit by laser welding.

Accordingly, it is an object of this invention to provide stabilizer units including non-integral stabilizer fins joined into the central body of the stabilizer unit by an injection molding polymer.

It is a further object of this invention to provide composite stabilizer units including non-integral stabilizer fins joined into the central body of the stabilizer unit wherein the central body of the stabilizer unit is comprised of the engineering grade polymer.

It is a still further object of this invention to provide stabilizer units formed by an injection molding process wherein the non-integral stabilizer fins are simultaneously joined by an engineering grade polymer in an injection molding process to the stabilizer unit body as the stabilizer unit body, comprised of the engineering grade polymer, is joined in the injection molding process to the penetrator rod of the projectile.

SUMMARY OF THE INVENTION

To achieve the foregoing and other objects, and in accordance with the purposes of the present invention, as embodied and broadly described herein, the present invention provides an improvement in a fin stabilized projectile including multiple stabilizer fins upon a stabilizer unit, having a central body and peripherally located stabilizer fins, situated at the aft end of the projectile, the improvement being that the stabilizer fins are non-integral fins joined into the stabilizer unit by an injection molded engineering grade polymer, the central body of the stabilizer unit comprised of the engineering grade polymer and formed in the injection molding process. A further improvement of the present invention comprises simultaneously joining the stabilizer unit onto a penetrator rod of the projectile by the injection molded engineering grade polymer as the non-integral stabilizer fins are joined into the stabilizer unit.

DETAILED DESCRIPTION

Figure 1:
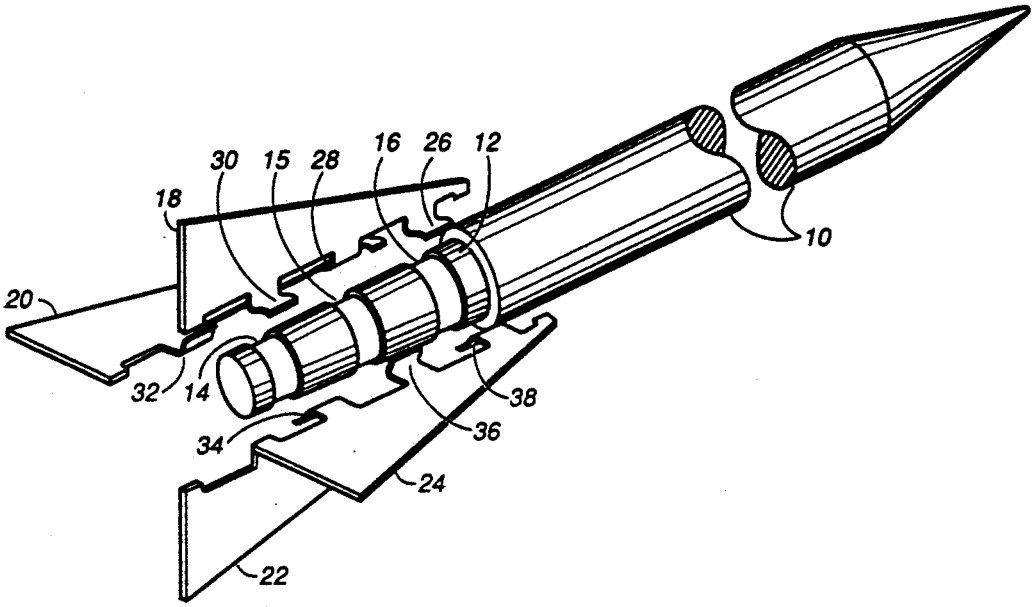
FIG. 1 is a perspective view of the finally fabricated stabilizer unit attached to a penetrator rod of a projectile in accordance with the present invention.
Figure 2:
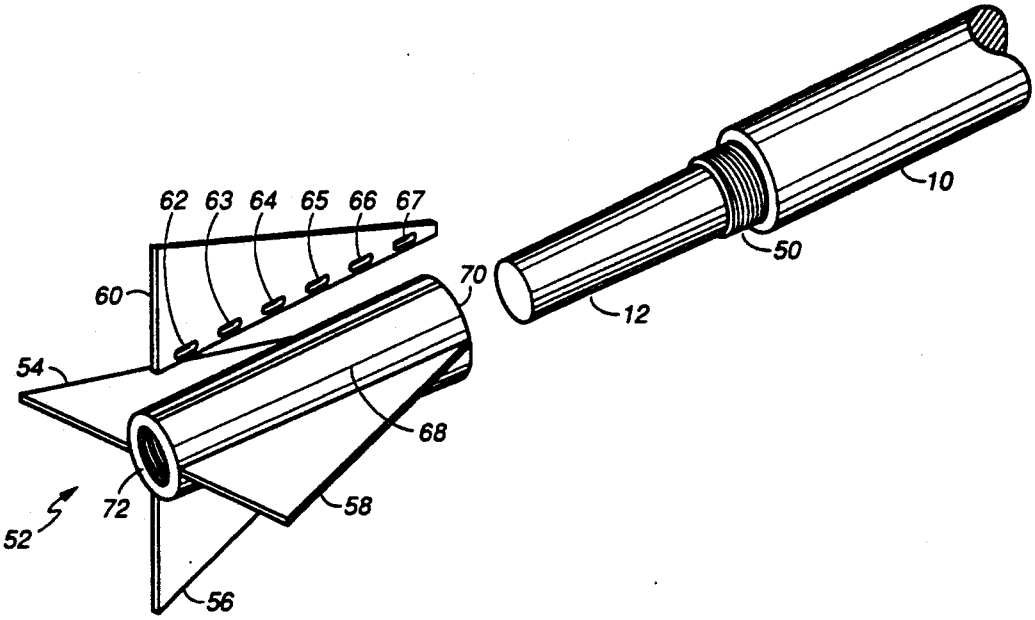
FIG. 2 is a perspective view of a fabricated stabilizer unit having threading for attachment to a penetrator rod of a projectile.

The present invention concerns composite stabilizer units and the production of such composite stabilizer units for the aft end of a projectile such as a long rod penetrator military round, e.g., the Armor Piercing Fin Stabilized Discarding Sabot (APFSDS), or other projectiles such as one fired from an electromagnetic rail gun. The composite stabilizer unit includes non-integral stabilizer fins joined by an injection molded engineering grade polymer to the central body of the stabilizer unit, such central body comprised of the engineering grade polymer. The particular stabilizer fins could be metal, ceramic or polymer composites depending upon the particular application and the environment to be encountered. In the injection molding process, the stabilizer fins can be inserted into an injection mold, the mold cavity configured to allow formation of the stabilizer unit body from an engineering grade thermoplastic or thermoset polymer as the stabilizer fins are joined into the central body of the stabilizer unit. The mold cavity can also include suitable threads by which the stabilizer unit could be threaded onto the projectile. Optionally, the stabilizer unit including the stabilizer fins could be joined directly to, e.g., the long rod penetrator of the projectile, by injection molding as the stabilizer fins are joined into the body of the stabilizer unit thereby eliminating the need for threads. Additionally, there may be threads or other suitable means for attachment for a typical tracer pellet at the aft end of the stabilizer unit FIGS. 1 and 2 show the improved assembly of the present invention with FIG. 1 representing a preferred embodiment. A projectile 10 includes a central penetrator rod 12 having grooves 14, 15 and 16 in the surface of penetrator rod 12. Stabilizer fins 18, 20, 22 and 24 each have three tab segments for alignment within grooves 14, 15 and 16. Tab segments 26, 28, 30, 32, 34, 36, 38 and 40 are shown in FIG. 1. A stabilizer unit includes fins 18, 20, 22 and 24 and such fins are joined by in an injection molding process by in situ formed central body (not shown) of the stabilizer unit, the body comprised of an engineering grade polymer. The central body is also molded directly upon penetrator rod 12 to join in situ stabilizer unit to projectile 10. Stabilizer fins 18, 20, 22 and 24 are spaced substantially equiangularly around penetrator rod 12. The number of stabilizer fins and the number of tab segments and grooves can be changed as desired for the particular application.

Another embodiment is illustrated by FIG. 2 which shows projectile 10 with penetrator rod 12 having threads 50 upon rod 12. A separate stabilizer unit 52 includes stabilizer fins 54, 56, 58 and 60. Stabilizer fin 60 is shown out of the assembly and slots 62, 63, 64, 65, 66, and 67 defined within the surface of stabilizer fin 60 can be seen. The molding material or engineering grade polymer forming a central body 68 of stabilizer unit 60 is able to flow through slots 62, 63, 64, 65, 66, and 67 during manufacture of stabilizer 52 unit and secure the fins to the in situ formed central body of the stabilizer unit. Stabilizer unit 60 includes threads 70 for joining onto threads 50 of rod 12. Additionally, stabilizer unit 60 can include threads 72 for attaching a tracer pellet 74 in the aft end of the projectile.

Figure 3:
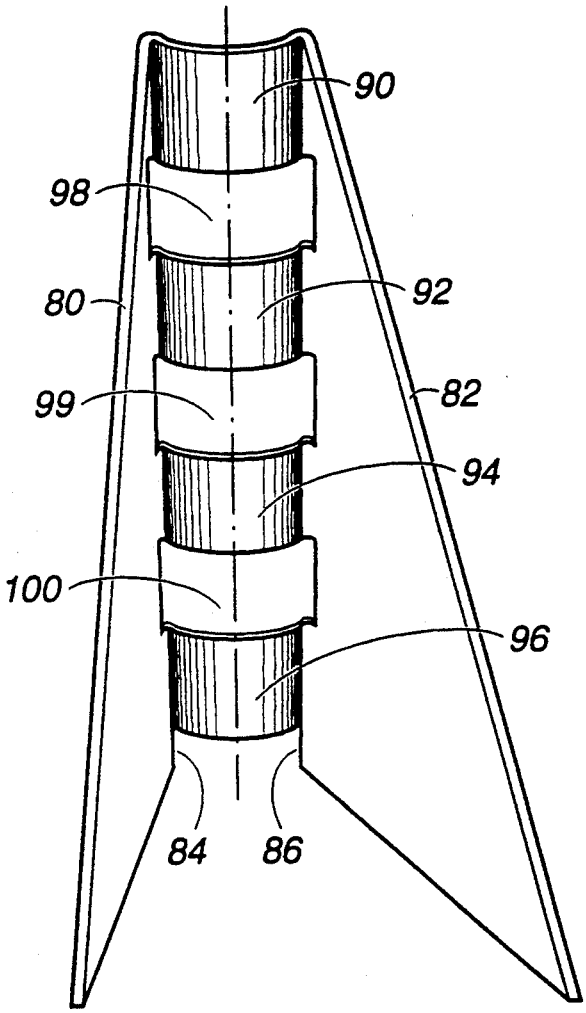
FIG. 3 is a view of an individual shape of a stabilizer fin segments.

FIG. 3 illustrates a stabilizer fin having a pair of stabilizer fins 80 and 82 connected at bases 84 and 86 of the stabilizer fins by connecting strips 90, 92, 94, and 96. The connecting strips define openings 98, 99, and 100 through which the engineering grade polymer can flow during the molding process. Connecting strips 90, 92, 94, and 96 have an appropriate curvature to either align snuggly with a penetrator rod where the stabilizer unit is in situ joined onto the projectile or to align with the curvature of the central body of a stabilizer unit formed around the connecting strips during the molding process.

The ability to fabricate the individual stabilizer fins separately from the stabilizer unit of the projectile allows for wider selection of materials useful in forming the stabilizer fins. For example, the stabilizer fins can be formed of ferrous and nonferrous metals, e.g., steel, titanium, or aluminum, ferrous and nonferrous metal matrix composites, i.e., polymer matrixes containing the respective metal such a steel or titanium as filler, polymer materials such as both reinforced or non-reinforced thermoplastics or thermosets, composite materials such as laminated polymer composites, or molded reinforced polymers, or from reinforced or non-reinforced ceramics such as, e.g., transformation toughened zirconium, zirconium toughened alumina, silicon nitride, silicon carbide, or silica-based whisker ceramic composites. Choice of the material for the stabilizer fins will depend upon the particular application and the particular hostile environment encountered in such an application. For example, in typical cannons or guns the fins can need to endure a gunpowder environment, while in a railgun fired projectile the fins would need to endure greater gravity or G-effects and a higher ablative atmosphere.

Additionally, protective coatings or anti-friction coatings may be used together with the stabilizer fins as is appropriate and such coatings are well known to those skilled in the art.

Polymers that may be particular useful in the fabrication of the tail fins are those polymers generally referred to as "engineering grade plastics or polymers" and such polymers include, e.g., polyaryletherketones, polyamide-imides, polycarbonates, polyetheretherketones, polyetherketones, polyetherketoneketones, polyimides, polyetherimides, polysulfones, polyethersulfones, reinforced epoxies and reinforced phenolics. Generally, engineering grade polymers have a good balance of high tensile properties, stiffness, compressive and shear strength, as well as impact resistance. Their high physical strength properties are reproducible and predictable, and they retain their physical and electrical properties over a wide range of environmental conditions such as heat, cold, or chemical exposure. They also can resist mechanical stress for long periods of time.

Polyaryletherketones, sometimes referred to as "PAEKs", are commercially available from BASF under the trademark "ULTRAPEK", and from Amoco Performance Products under the trademark "KADEL".

Polyamide-imides, sometimes referred to as "PAIs", are commercially available, for example, from Amoco Performance Products, Inc. under the trademarks "TORLON" and AI-10.

Polycarbonates are commercially available from G. E. Plastics under the trademark "LEXAN".

Polyetheretherketones or polydietherketones, sometimes referred to as "PEEKs", are commercially available, for example, from ICI Americas, Inc. under the trademark "VICTREX".

Polyetherketones, sometimes referred to as "PEKs", are commercially available, for example, from ICI Americas, Inc. under the trademark "VICTREX", from BASF under the trademark "ULTRAPEK", and from Hoechst Celenase under the trademark "HOSTATEC".

Polyetherketoneketones or polyetherdiketones, sometimes referred to as "PEKKs", are commercially available, for example, from E. I. DuPont de Neumors under the trademark "DECLAR".

Polyimides are commercially available, for example, from Monsanto Co. under the trademark "SKYBOND".

Polyetherimides, sometimes referred to as "PEIs" are commercially available, for example, from G. E. Plastics under the trademark "ULTEM".

Polysulfones are commercially available, for example, from Amoco Performance Products, Inc. under the trademarks "UDEL".

Polyethersulfones are commercially available, for example, from ICI Americas, Inc. under the trademark "VICTREX".

Polyaryletherketones are particularly preferred as the injection molding engineering grade polymer.

Suitable reinforcing materials for the various polymer materials can include, e.g., reinforcing fibers of, e.g., carbon or graphite such as short strand carbon, aramid, glass, quartz, silicon carbide, ceramic, metal-coated carbon, metals such as stainless steel, boron, copper, nickel, and the like, and mixture thereof. Presently preferred fibers include carbon, glass, and aramid.

The diameter of such reinforcing fibers generally ranges from about 10 to about 500 microns, but larger and smaller diameter fibers can be used. More preferably, the diameter of such reinforcing fibers is generally from about 20 to about 100 microns.

The stabilizer fins can be attached into the stabilizer unit by use of open areas, i.e., holes or slots, in the stabilizer fins through which the injection molded engineering grade polymer or plastic can flow and thereby secure the stabilizer fins into the stabilizer unit. Optionally, the stabilizer fins could have one or more bent tabs configured to align with grooves in, e.g., the penetrator rod of the projectile. In another embodiment, the stabilizer fins can be joined as, e.g., a pair of stabilizer fins, and such a pair of stabilizer fins can then be joined as a single segment into the stabilizer unit. For example, a pair of stabilizer fins can be joined by a strip of similar material as the stabilizer fins at the base edge of the stabilizer fins thereby forming a u-type shape. Such a u-type assembly can be configured by an appropriate curvature of the joining strip so that the assembly can be snugly placed adjacent to the circumference of body of the penetrator rod, i.e., the projectile or the curvature can relate to the geometry of the in situ formed central body of the stabilizer unit which can encompass the joining strips to secure the stabilizer fins.

Injection molding processes are well known to those skilled in the art. Generally, such injection molding processes involve placing the parts to be joined into a suitably prepared molding machine, such as those available from Cincinnati Milacron, Klockner Windsor or Klockner Ferromatik Desma GmbH, and holding the parts as the molding material is forced into the mold. Typical temperatures for such processes can range from about 300° F. to about 1000° F., more preferably from about 500° F. to about 800° F., while typical pressures can range from about 5000 psi to about 30,000 psi, more preferably from about 10,000 psi to about 25,000 psi.

The present invention is more particularly described in the following examples which are intended as illustrative only, since numerous modifications and variations will be apparent to those skilled in the art.

EXAMPLE 1

A stabilizer unit is formed in a process generally known as insert injection molding. Titanium stabilizer fin segments are loaded into an injection mold machine with a mold cavity having the preformed shape of the stabilizer unit. An engineering grade polymer of a polyaryletherketone, such as that polymer commercially available from BASF under the trademark "ULTRAPEK", loaded with about 30 percent by weight of glass fibers and injected into the mold to flow and form within the preformed voids at temperatures of about 788° F. and thereafter subjected to pressures of about 20,000 pounds per square inch for between one and two minutes. After cooling to temperatures below the glass transition temperature of the polymer, the completed stabilizer unit is removed from the mold.

EXAMPLE 2

Titanium stabilizer fin segments, and a penetrator rod of a projectile are loaded into an injection mold machine with a mold cavity having the preformed shape of the stabilizer unit. An engineering grade polymer of a polyaryletherketone, such as that polymer commercially available from BASF under the trademark "ULTRAPEK", loaded with about 30 percent by weight of glass fibers and injected into the mold to flow and form within the preformed voids at temperatures of about 788° F. and thereafter subjected to pressures of about 20,000 pounds per square inch for between one and two minutes. After cooling to temperatures below the glass transition temperature of the polymer, the completed stabilizer unit already securely linked to the penetrator rod is removed from the mold.

Although the present invention has been described with reference to specific details, it is not intended that such details should be regarded as limitations upon the scope of the invention, except as and to the extent that they are included in the accompanying claims.

What is claimed is:

1. In a fin stabilized projectile including multiple stabilizer fins upon a stabilizer unit, having a central body and peripherally located stabilizer fins, situated at the aft end of the projectile, the improvement wherein prefabricated multiple stabilizer fins are joined into the stabilizer unit by an injection molded engineering grade polymer, the central body of the stabilizer unit formed in the injection molding process and comprised of the engineering grade polymer, and the prefabricated multiple stabilizer fins are comprised of reinforced polymeric material.

2. In the fin stabilized projectile of claim 1, the further improvement wherein the injection molded engineering grade polymer is selected from the group consisting of polyaryletherketones, polyamide-imides, polycarbonates, polyetheretherketones, polyetherketones, polyetherketoneketones, polyimide, polyetherimides, polysulfones, polyethersulfones, reinforced epoxies or reinforced phenolics.

3. In a fin stabilized projectile including multiple stabilizer fins upon a stabilizer unit, having a central body and peripherally located stabilizer fins, situated at the aft end of the projectile, the improvement wherein the multiple stabilizer fins are comprised of titanium, aluminum or steel and are joined into the stabilizer unit by an injection molded engineering grade polymer, the central body of the stabilizer unit formed in the injection molding process and comprised of the engineering grade polymer.

4. In the fin stabilized projectile of claim 3, the further improvement wherein the stabilizer unit is joined at the aft end of the projectile by an injection molded engineering grade polymer.

5. The fin stabilized projectile of claim 4 wherein the multiple stabilizer fins include openings within the stabilizer fins through which the injection molded engineering grade polymer can flow thereby securing the stabilizer fins to the stabilizer unit.

6. The fin stabilized projectile of claim 4 wherein the multiple stabilizer fins include double stabilizer fin segments joined together by a connecting strip at a base edge of each individual stabilizer fin of the double fin segment, the connecting strip of each double stabilizer fin segment configured to securely align with the circumference of the projectile.

7. The fin stabilized projectile of claim 3 wherein the multiple stabilizer fins include tab segments.

8. The fin stabilized projectile of claim 4 wherein the multiple stabilizer fins include tab segments configured to align with grooves in the projectile.

9. The fin stabilized projectile of claim 3 wherein the multiple stabilizer fins include openings within the stabilizer fins through which the injection molded engineering grade polymer can flow thereby securing the stabilizer fins into the stabilizer unit.

10. The fin stabilized projectile of claim 3 wherein the multiple stabilizer fins include double stabilizer fin segments joined together by a connecting strip at a base edge of each individual stabilizer fin of the double fin segment, the connecting strip of each double stabilizer fin segment configured to align with the geometry of the central body of the stabilizer unit.

11. In a method of assembling a fin stabilized projectile including multiple stabilizer fins upon a stabilizer unit having a central body and peripherally located stabilizer fins situated at the aft end of the projectile having a central core, by forming a stabilizer unit and attaching a stabilizer unit to the central core of the projectile, the improvement in forming the stabilizer unit comprising joining prefabricated multiple stabilizer fins into the stabilizer unit by injection molding an engineering grade polymer at least around a portion of the prefabricated multiple stabilizer fins, and simultaneously forming the central body of the stabilizer unit of the engineering grade polymer in the injection molding.

12. In a fin stabilized projectile including multiple stabilizer fins upon a stabilizer unit, having a central body and peripherally located stabilizer fins, situated at the aft end of the projectile, the improvement wherein the multiple stabilizer fins are comprised of reinforced or nonreinforced ceramic material and are joined into the stabilizer unit by an injection molded engineering grade polymer, the central body of the stabilizer unit formed in the injection molding process and comprised of the engineering grade polymer.

13. In a method of assembling a fin stabilized projectile including multiple stabilizer fins upon a stabilizer unit having a central body and peripherally located stabilizer fins situated at the aft end of the projectile having a central core, by forming a stabilizer unit and attaching the stabilizer unit to the central core of the projectile, the improvement in forming the stabilizer unit comprising joining multiple stabilizer fins comprised of titanium, aluminum or steel into the stabilizer unit by injection molding and engineering grade polymer at least around a portion of the multiple stabilizer fins, and simultaneously forming the central body of the stabilizer unit of the engineering grade polymer in the injection molding.

14. In a method of assembling a fin stabilized projectile including multiple stabilizer fins upon a stabilizer unit having a central body and peripherally located stabilizer fins situated at the aft end of the projectile having a central core, by forming a stabilizer unit and attaching the stabilizer unit to the central core of the projectile, the improvement in forming the stabilizer unit comprising joining multiple stabilizer fins comprised of reinforced or nonreinforced polymeric material into the stabilizer unit by injection molding an engineering grade polymer at least around a portion of the multiple stabilizer fins, and simultaneously forming the central body of the stabilizer unit of the engineering grade polymer in the injection molding.

15. In a method of assembling a fin stabilized projectile including multiple stabilizer fins upon a stabilizer unit having a central body and peripherally located stabilizer fins situated at the aft end of the projectile having a central core, by forming a stabilizer unit and attaching the stabilizer unit to the central core of the projectile, the improvement in forming the stabilizer unit comprising joining multiple stabilizer fins comprised of reinforced or nonreinforced ceramic material into the stabilizer unit by injection molding an engineering grade polymer at least around a portion of the multiple stabilizer fins, and simultaneously forming the central body of the stabilizer unit of the engineering grade polymer in the injection molding.

16. In a method of assembling a fin stabilized projectile including multiple stabilizer fins upon a stabilizer unit having a central body and peripherally located stabilizer fins situated at the aft end of the projectile having a central core, by forming a stabilizer unit and attaching the stabilizer unit to the central core of the projectile, the improvement in forming the stabilizer unit comprising joining multiple stabilizer fins including tab segments into the stabilizer unit by injection molding an engineering grade polymer at least around a portion of the multiple stabilizer fins, and simultaneously forming the central body of the stabilizer unit of the engineering grade polymer in the injection molding.

17. In a method of assembling a fin stabilized projectile including multiple stabilizer fins upon a stabilizer unit having a central body and peripherally located stabilizer fins situated at the aft end of the projectile having a central core, by forming a stabilizer unit and attaching the stabilizer unit to the central core of the projectile, the improvement in forming the stabilizer unit comprising forming grooves in the central core of the projectile, aligning multiple stabilizer fins including tab segments configured to align with said grooves in the central core of the projectile with said grooves, and joining the multiple stabilizer fins by injection molding an engineering grade polymer at least around a portion of the multiple stabilizer fins.

18. In a method of assembling a fin stabilized projectile including multiple stabilizer fins upon a stabilizer unit having a central body and peripherally located stabilizer fins situated at the aft end of the projectile having a central core, by forming a stabilizer unit and attaching the stabilizer unit to the central core of the projectile, the improvement in forming the stabilizer unit comprising joining prefabricated multiple stabilizer fins into the stabilizer unit by injection molding an engineering grade polymer at least around a portion of the prefabricated multiple stabilizer fins, simultaneously forming the central body of the stabilizer unit of the engineering grade polymer in the injection molding, and simultaneously joining the stabilizer unit to the central core of the projectile by injection molding an engineering grade polymer.

* * * * *